US005670075A

United States Patent [19]

Vassilicos

[11] Patent Number: 5,670,075

[45] Date of Patent: Sep. 23, 1997

[54] SEALING GAS DELIVERY SYSTEM FOR SLIDING JOINTS

[75] Inventor: Achilles Vassilicos, Pittsburgh, Pa.

[73] Assignee: USX Corporation, Pittsburgh, Pa.

[21] Appl. No.: 589,392

[22] Filed: Jan. 22, 1996

[51] Int. Cl.[6] ..... B22D 41/24; B22D 41/28; B22D 41/42

[52] U.S. Cl. ..... 222/603; 164/415; 164/437; 222/600

[58] Field of Search ..... 164/475, 488, 164/66.1, 67.1, 415, 259, 437; 222/603, 600, 606, 607

[56] References Cited

U.S. PATENT DOCUMENTS

| | | | |
|---|---|---|---|
| 3,253,307 | 5/1966 | Griffiths et al. | 222/603 X |
| 3,459,346 | 8/1969 | Tinnes | 222/600 X |
| 3,731,912 | 5/1973 | Kutzer | 222/600 |
| 3,838,798 | 10/1974 | Voss | 222/603 |
| 3,887,117 | 6/1975 | Fehling | 222/600 |
| 4,003,561 | 1/1977 | Cudby | 266/220 |
| 4,429,816 | 2/1984 | Thrower | 164/475 X |
| 4,576,317 | 3/1986 | Wenger | 222/600 |
| 4,854,487 | 8/1989 | Ando et al. | 222/606 |
| 5,100,034 | 3/1992 | Russo | 222/600 |
| 5,118,016 | 6/1992 | Eisermann et al. | 222/597 |

FOREIGN PATENT DOCUMENTS

| | | | |
|---|---|---|---|
| 58-50161 | 3/1983 | Japan | 164/475 |
| 59-225862 | 12/1984 | Japan | 164/475 |
| 62-279072 | 12/1987 | Japan | 222/606 |
| 1-30976 | 12/1989 | Japan | 222/603 |
| 2-235565 | 9/1990 | Japan | 222/600 |

OTHER PUBLICATIONS

Vassilicos SN 08/508,261 filed Jul. 27, 1995 "Apparatus for Limiting Ingress of Gas to Incipient Continuous Cast Slabs".

Translation of Japanese Patent Publication 59–225862 Published Dec. 18, 1984.

Translation of Japanese Patent Publication 2–235565 Published Sep. 18, 1990.

*Primary Examiner*—J. Reed Batten, Jr.

*Attorney, Agent, or Firm*—William L. Krayer

[57] ABSTRACT

In the continuous casting of steel, gas is prevented or inhibited from contacting molten steel through the valve slide plate by feeding inert gas through channels in the slide plate and adjacent parts; the channels contain porous refractory inserts and can be connected to outside sources through juxtaposed side channels.

14 Claims, 7 Drawing Sheets

SEALING GAS DELIVERY SYSTEM FOR SLIDING JOINTS

TECHNICAL FIELD

This invention relates to valves used in the continuous casting of metal, especially steel. In particular, it relates to delivery systems for inert gas to the mating surfaces of sliding gate valves and stopper rod flow control valves or systems to effect a seal by generating a positive pressure of gas between the mating surfaces to inhibit the entry of ambient gases such as air which could degrade the quality of the metal being cast and to help minimize the entry of molten metal to the interface. The invention involves the use of a porous refractory insert in a channel around or partially around the valve opening, occupying only part of the channel so that the gas can be evenly distributed in the circumferential recess behind (upstream from) the porous refractory. The porous refractory insert evenly distributes the flow of inert gas between the contacting surfaces which are moved in contact with each other such as the contacting surfaces of the slide plate and the tube holder and/or the slide plate and the top plate, the tube holder and the nozzle, and other similar interfaced surfaces which slide or move with respect to each other.

BACKGROUND OF THE INVENTION

Along with the widespread acceptance of continuous casting as a method of proceeding directly from steel making to slabs and other semifinished forms of steel, the art has developed various methods and apparatus for controlling the pouring or other introduction of molten metal into the top of the incipient slab just before it enters a cooled mold. Sliding gate valves and stopper-rod valves with on-line pouring tube change capability have been found to be quite practical and are widely used. There is still room for improvement, however, in the control of the seepage of gas through the mating surfaces of the valve. Such slide valves and stopper rod valves obviously operate under difficult conditions; they are directly contacted with molten metal which has a tendency to splash and freeze. Having movable components, they are subject to some wear, and, since they comprise two or more joints of wide surface areas, gases such as air are likely to find fissures and cracks through the interfaces to the flowing metal where pressures are almost always less than the ambient pressures outside the unit; such gases can cause unwanted reactions with the molten steel.

In U.S. Pat. No. 3,887,117, Fehling describes a U-shaped channel to be placed in the slide or the complementary stationary part of the valve. The U-shaped channel is ground into the refractory of the unit and inert gas is fed to it from an outside source. The inert gas provides a positive pressure with respect to the atmosphere outside the valve. This kind of construction is subject to the possibility of molten metal finding its way into the channel and blocking the passage of gas. Russo, in U.S. Pat. No. 5,100,034, purports to improve upon Fehling by inserting porous refractory in a similar channel. But Russo feeds his gas to one portion only of the refractory, thus requiring the gas to pass through the refractory before entering an open space leading to the fissures to be sealed. This configuration leads to considerable variation in gas pressure in different areas of the unit; also the refractory cannot physically block the spillage of molten metal into the channel.

In U.S. Pat. No. 4,576,317, Wenger discloses an improvement on the Fehling '117 concept, by providing a second U-shaped channel in the complementary slide surface, dimensioned so that the channels will overlap in certain positions. A vacuum is drawn on the channels.

The present inventor, on Jul. 27, 1995, filed a U.S. patent application, Ser. No. 08/508,261, which describes inert gas channels partially filled with porous refractory built into the mating surfaces of the joint between the pour tube and the tube holder in a continuous caster similar to the type described in the present application.

It should be kept in mind in considering the construction of devices for feeding inert gas to the contacting surfaces in slide gate valves that it is generally more convenient to feed the gas through the stationary portions of the valve than through the moving slide; however, the present invention is not so limited.

SUMMARY OF THE INVENTION

I have invented an apparatus and method for feeding inert gas into the interface of a movable member and a stationary member of a gate valve such as used to control the pouring of molten steel into a continuous caster. In the case of the stopper-rod valve, the movable member is the tube holder or submerged nozzle and the stationary member is the tundish nozzle or an intermediate plate, depending on the particular construction. A preferred form of the invention involves the use of a channel, preferably generally U-shaped, in the surface of the slide, and another channel, also preferably generally U-shaped, in the mating surface of at least one of the stationary portions of the valve. Each of the channels is partially filled with a porous refractory insert, in such a way that the outer surface of the refractory is level with the respective mating surface, leaving an unoccupied area of the channel deeper into the slide or stationary portion, so that an open area or passage is, provided over the entire internal surface of the porous refractory insert. This open area or passage in the channel is connected to a duct for a source of inert gas, which is then provided at pressures which are equal over the entire internal surface of the porous refractory insert. For conveying the gas from one element to another, i.e. from the stationary portion of the valve to the slide plate, open channels are provided in position so that, when they are juxtaposed, gas can pass freely from one to the other.

BRIEF DESCRIPTION OF THE DRAWINGS

FIGS. 2, 3, 4, 5, and 6 are directed to this type of valve.

FIG. 2 is a simplified side sectional view of a slide gate valve, showing the top plate, the slide plate, and the tube holder, together with a preferred configuration of my gas delivery system.

FIGS. 3, 3*d*, and 3*e* show the relationship of the features of FIGS. 3*a* and 3*b* as the slide plate is moved leftward into the "fully closed" or "entry" position (3*c*), the "throttle" or working position (3*d*), and the "exit" position (3*e*).

FIG. 5 is a perspective view of a slide plate according to the invention

FIG. 6 is a perspective view of a variation of a slide plate according to the invention.

DETAILED DESCRIPTION OF THE INVENTION

Figure 1A:
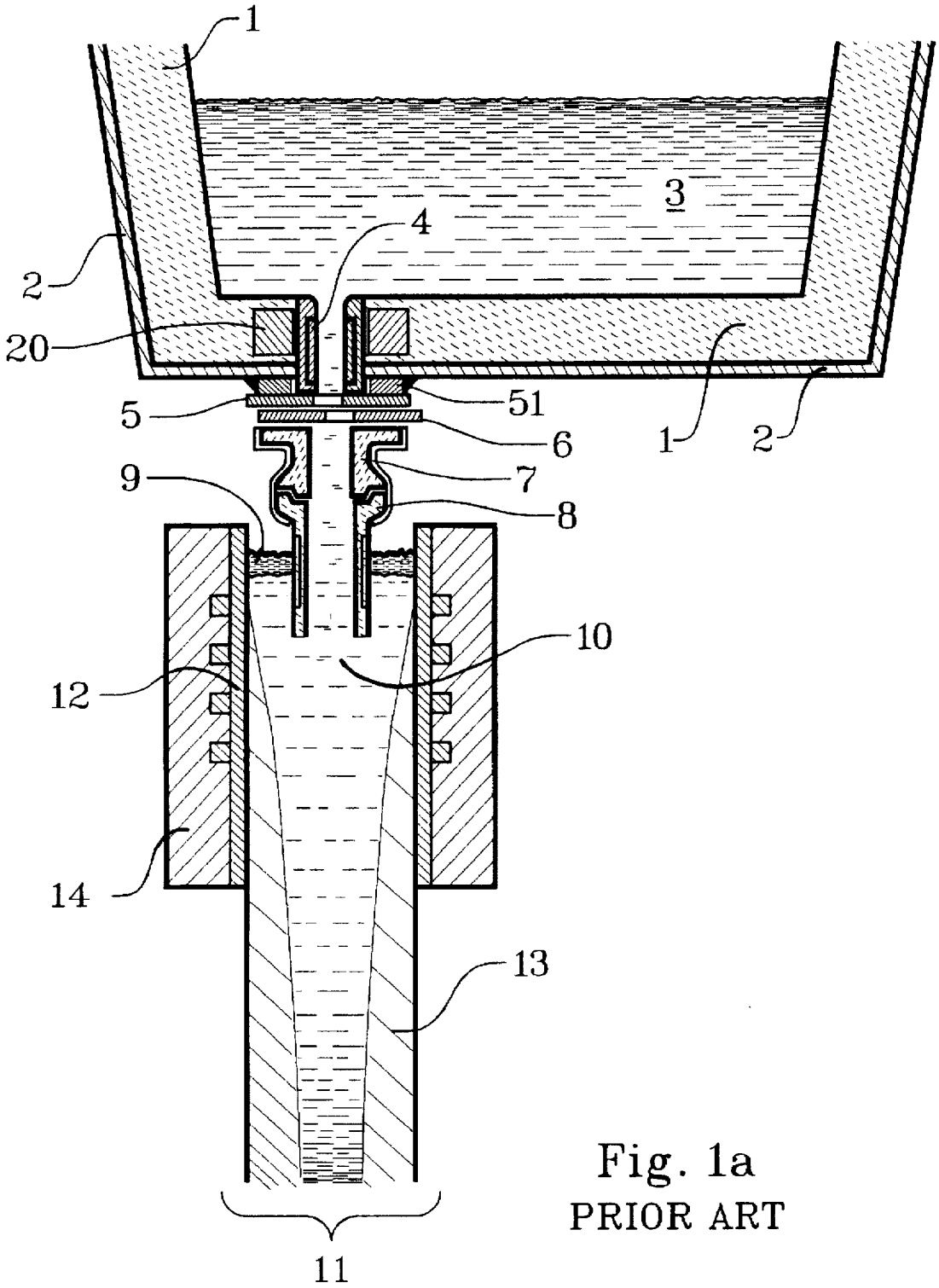
Fig. 1a PRIOR ART
FIG. 1*a* is a side elevational view of the upper region of a typical prior art commercial continuous caster for steel, showing the placement of the commonly used slide gate valve.

Referring now to FIG. 1*a*, this more or less conventional assembly includes a tundish 2 having a refractory lining i containing liquid steel 3 for forming into a continuous slab. Control of the flow of steel through refractory nozzle 4 (which is secured by well block 20) is by a sliding gate valve comprising top plate 5 and slide plate 6 as is known in the art. Top plate 5 may be secured to mounting plate 51. Directly beneath the slide plate 6 is tube holder 7 and fixed directly beneath it is pour tube 8. In operation, pour tube 8 passes directly through slag layer 9 on the top of the incipient slab 11, which is formed from molten steel 10 deposited near the top of the incipient slab 11 while being exposed to as little atmosphere as possible. Water-cooled copper mold 12 solidifies the steel sufficiently so that by the time it exits mold 12 at its bottom, it has formed a hard shell 13 strong enough to contain the still molten steel 10 in its center. Copper mold 12 is reinforced by a steel envelope 14 around it. The rate of passage of molten steel 3 through the slide plate 6 is controlled so as to simultaneously (1) prevent an overflow of mold 12 (2) maintain a constant molten metal level and (3) keep up with the solidification and production rates of the slab 11.

Figure 1B:
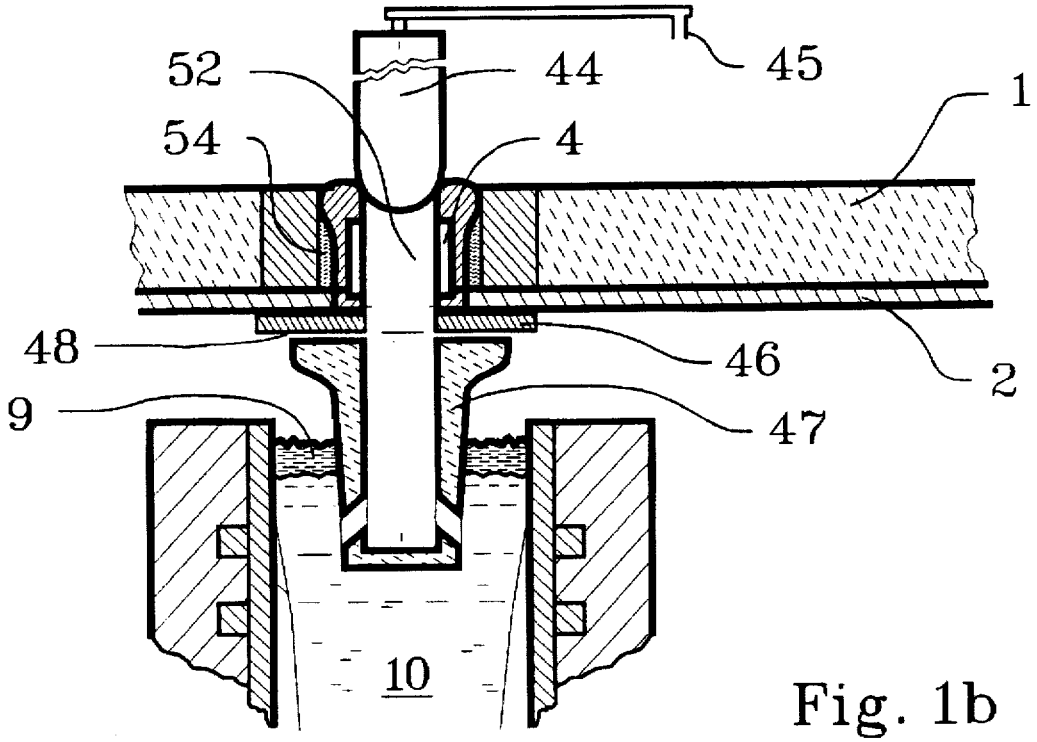
Fig. 1b PRIOR ART
FIG. 1*b* and 1*c* show prior art stopper rod arrangements to which my invention is also applicable.

FIG. 1*b* illustrates a variation of the prior art to which the present invention is also applicable. In this variation, the submerged entry nozzle 47 passes through slag layer 9 as in FIG. 1*a*, but there is no slide plate 6 (FIG. 1*a*); rather, flow of metal is stopped by the insertion, by manipulator 45, of stopper 44 into refractory nozzle 4. Refractory nozzle 4 may be surrounded by mortar 54. Submerged entry nozzle 47 may then be replaced by moving it horizontally, maintaining contact with fixed plate 46 at interface 48, which retains molten metal in passage 52. A new submerged entry nozzle 47 follows horizontally, also maintaining contact with fixed plate 46 at interface 48. As will be seen hereafter, the movement of the submerged entry nozzle 47 across interface 48 is exactly comparable for our purposes to the movement of the upper surface of slide plate 6 with respect to the under side of top plate 5 as depicted in FIGS. 4*a*–4*e*. That is, the gas delivery system of FIGS. 4*a*–4*e* can be applied exactly to the variation of FIG. 1*b*.

Figure 1C:
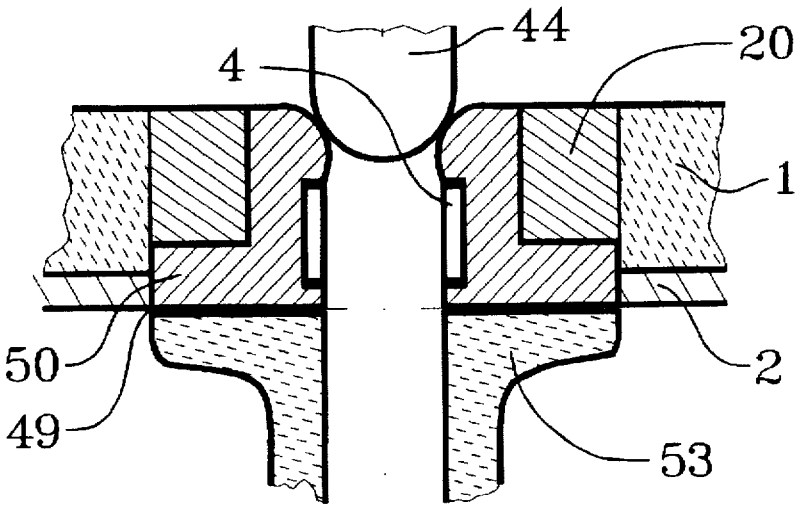
Fig. 1c PRIOR ART

In FIG. 1*c*, another variation is shown in which the refractory nozzle 4 is combined with the shell of tundish 2 to form an integral nozzle/top plate 50, forming an interface 49 directly with tube holder 53. Tube holder 53 may be replaced in a manner similar to the replacement of submerged entry nozzle 47 in FIG. 1*b*—that is, it is moved horizontally, keeping it in contact with nozzle/top plate 50 at interface 49 while stopper 44 halts the flow of metal. Again, the upper surface of tube holder 53 can be comparable to the upper surface of slide plate 6 as illustrated in FIGS. 4*a*–4*e* and the under surface of nozzle/top plate 50; both may be equipped with a gas delivery system exactly as described in FIGS. 4*a*–4*e*.

Figure 2:
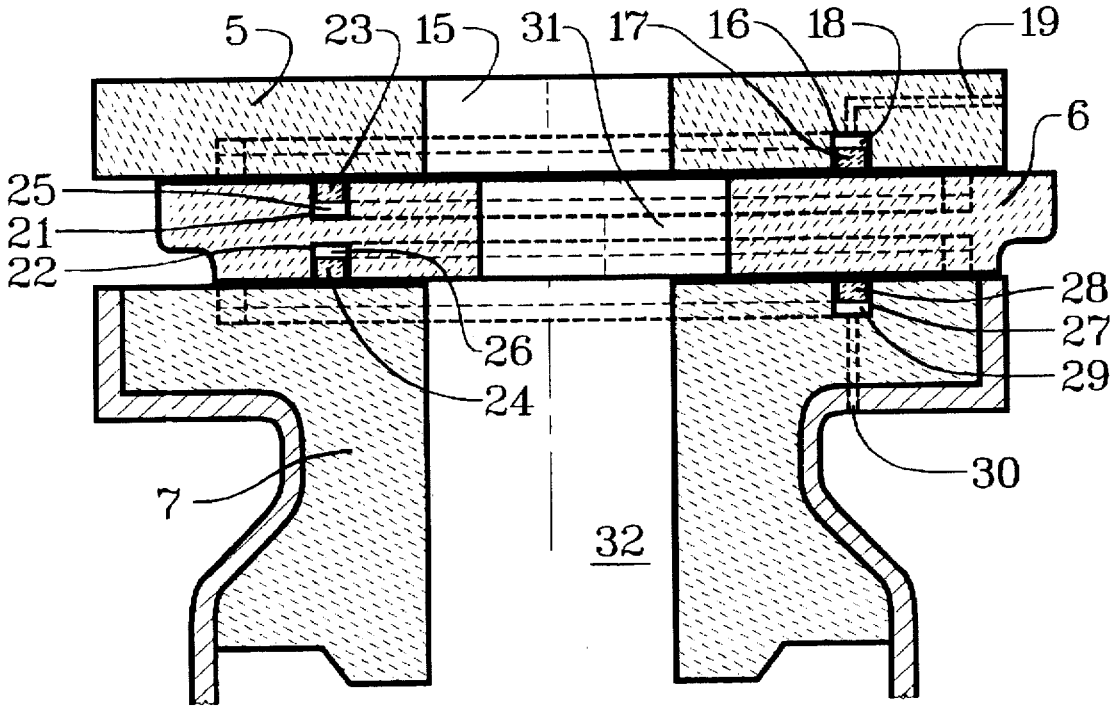
Figure 6:
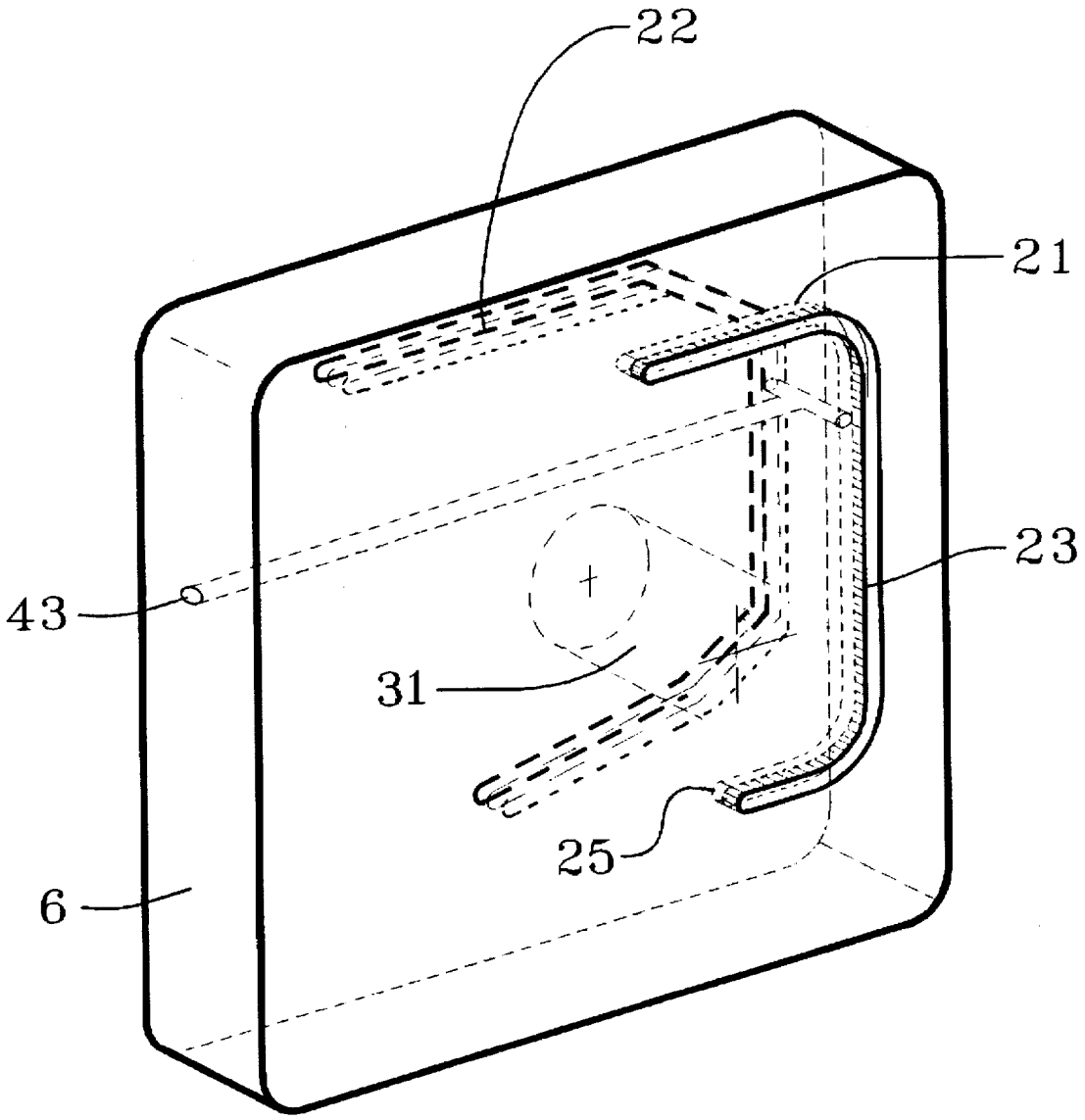

In FIG. 2, top plate 5 is seen to have an orifice 15 and a gas delivery channel 16, the lower part of which is filled with a porous refractory 17, leaving a passage 18 connecting with a gas duct 19 which is in turn connected to a source of inert gas, not shown, under pressure. Slide plate 6 has an orifice 31 and gas delivery channels 21 and 22 similar to gas delivery channel also only partly filled with refractory shapes 23 and 24, forming passages 25 and 26. The top of tube holder 7 also has a gas delivery channel 27 partly filled with refractory 28 and forming a passage 29. Passage 29 is connected to gas supply duct 30 in a manner similar to that of passage 18 and duct 19 on the top plate 5. Persons skilled in the art may recognize that the gas introduction through ducts 19 and 30 is contemplated in this embodiment only in the stationary parts, the top plate 5 and the tube holder 7. In principle, however, it is not necessary that gas introduction should only take place through a stationary part; rather, one may envision, for example, through the use of flexible tubing and the like, that the introduction could be in the slide plate 6, as is illustrated in FIG. 6.

The porous refractory I use for the channel insert may be any of the porous refractories known in the art, such as porous zirconia refractories or high-alumina porous refractory. In practice typically varying from one-quarter inch thick to three quarters inch thick, they should preferably provide no more than about 2 psi pressure drop (and in any event no more than about 4 psi pressure drop) when a standard inert gas such as argon is flowing through the insert at about 35 standard cubic feet per hour. The refractory may be formed in place in the channel or prefabricated and set into the channel with a sealant suitable for the conditions of pressure, temperature and wear; such sealants are known in the art.

The series of FIGS. 3*a*–3*e* are described specifically with respect to the configurations of FIGS. 1*a* and 2, although, as will appear, in principle they are equally appropriate for the configurations of FIGS. 1*b* and 1*c*.

Figure 3A:
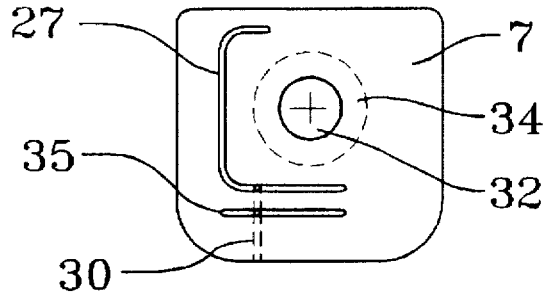
FIG. 3*a* is a simplified overhead view of the upper surface of the tube holder, showing only the features of the upper surface.

FIG. 3*a* is a simplified overhead view of the top surface of tube holder 7, defining an orifice 32 within refractory insert 34 and showing gas delivery channel 27 and gas transfer channel 35. Gas delivery channel 27 may be seen to be generally U-shaped, as is preferred. Refractory 28, seen in FIG. 2 partially filling gas delivery channel 27, is not illustrated in FIG. 3. Duct 30 connects gas transfer channel 35 and gas delivery channel 27, and receives gas from an outside source not shown.

Figure 3B:
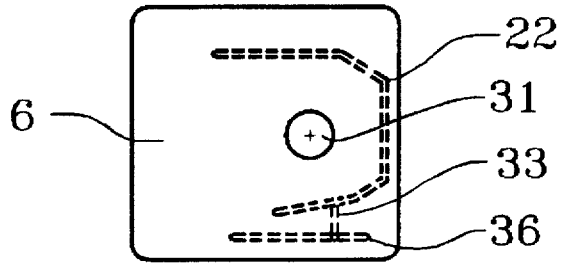
FIG. 3*b* is a simplified view of the under side of the slide plate, showing only the surface features. This under side of the slide plate will slide on the tube holder surface of FIG. 3*a*.

The slide plate 6 in FIG. 3*b* is viewed from above in a simplified manner showing only features directly relevant to its lower surface which will interface with tube holder 7. Slide plate 6 has gas transfer channel 36 and gas delivery channel 22 on its lower surface. Gas transfer channel 36 is connected to gas delivery channel 22 by duct 33. As will be seen in FIGS. 3*c*, 3*d*, and 3*e*, the dimensions of gas transfer channel 36 coordinate with the dimensions of gas transfer channel 35 on tube holder 7 (FIG. 3*a*) so a connection may be made to pass gas originating in duct 33 (FIG. 3*a*) and passed into gas transfer channel 35 of tube holder 7 to gas transfer channel 36 of slide plate 6. This is illustrated further in FIGS. 3*c*, 3*d*, and 3*e*.

Figure 3C:
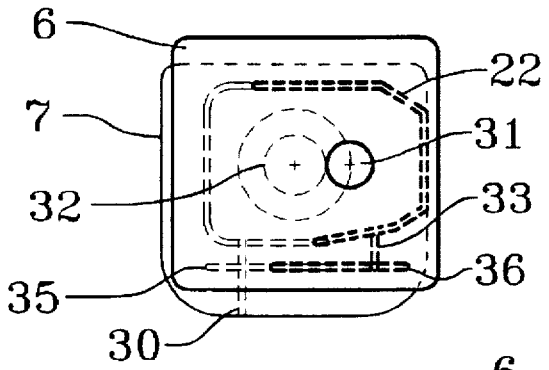

In FIG. 3*c*, the features of FIG. 3*b* have been juxtaposed on those of FIG. 3*a* to illustrate the relative positions of gas delivery channel 27 and gas transfer 35 of tube holder 7 with respect to gas delivery channel 22 and gas transfer channel 36 of slide plate 6. FIG. 3 is the first of the series 3*c*, 3*d*, and 3*e* showing the typical movement of the slide plate 6 over tube holder 7. The slide plate 6 moves from right to left, as depicted. When it reaches the "entry" or "fully closed" position of FIG. 3*c*, meaning there is not yet an overlap of orifice 31 and orifice 32, the gas transfer channels 35 and 36 have begun to overlap, permitting inert gas to travel from duct 30 through gas transfer channels 35 and 36 into duct 33 and further to gas delivery channel 22 of slide plate 6, while gas continues to fill gas delivery channel 27 in tube joint 7. The reader may observe that passages 26 and 29, and refractory inserts 24 and 28 are not shown, for the sake of simplicity, in FIG. 3; gas flow mentioned in the gas delivery channels 2 2 and 27 is confined to passages 26 and 29.

It may be observed that gas transfer channels 35 and 36 are somewhat removed from orifices 31 and 32. This is preferred because gas transfer channels 35 and 36 do not contain porous refractory inserts as do gas delivery channels 22 and 27; placement as far as practical from the molten metal is recommended to minimize the incidence of metal deposition. In addition, the gas transfer channels are linearly aligned with the sliding direction of the mating surfaces. This preferred form of interface further minimizes the possibility of deposition in these channels.

Figure 3D:
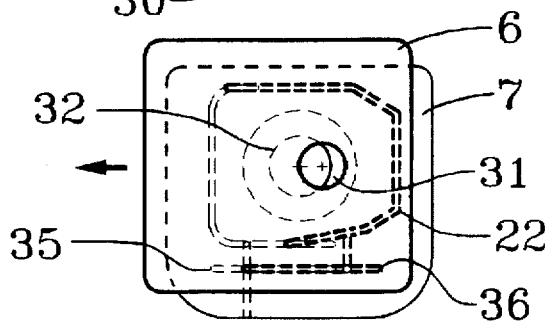

FIG. 3*d* shows the slide plate 6 having moved further to the left on tube holder 7 than shown in FIG. 3*c*, e.g. to the "throttle" position, or a position for normal or typical operation in which orifices 31 and 32 are overlapping but not concentric. Here there is more of an overlap of gas transfer channels 35 and 36 than was seen in FIG. 3*c*. Typically, gas flow will be maintained at a high rate in this position to overcome the negative gas pressure induced by the flow of metal through orifices 31 and 32.

Figure 3E:
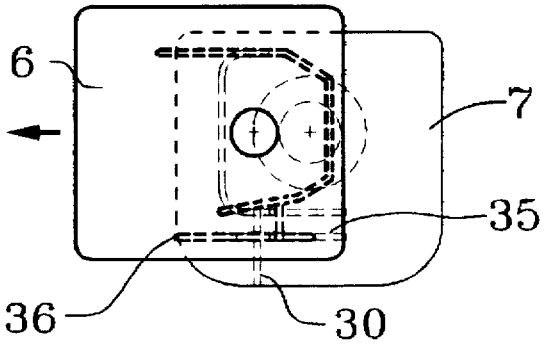

On termination of operation the slide plate 6 is typically moved further to the left (as depicted), at least to the "exit" position of FIG. 3*e*, where it will be seen orifices 31 and 32 no longer overlap and the flow of liquid steel 3 ceases. Gas transfer channels 35 and 36 may still overlap as shown but gas flow may be shut off at the operators' discretion.

As mentioned previously with respect to FIGS. 3*a*–3*e*, the series 4*a*–4*e* is described specifically for the configuration of FIG. 1*a* but the principle of operation is applicable to the "quick tube change" structures of FIGS. 1*b* and 1*c*.

Figure 4A:
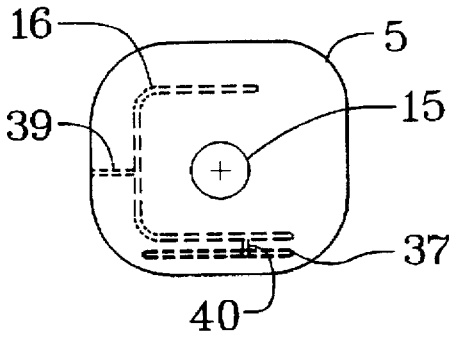
FIG. 4*a* is a simplified overhead view of the top plate, showing only the features on the under side.

In FIG. 4*a*, a simplified overhead view shows the top plate 5 having a generally U-shaped gas delivery channel 16 in its lower surface around orifice 15. Gas delivery channel 16 is connected to gas transfer channel 37 through duct 40. Gas delivery channel 16 is fed with inert gas from duct 39 from an outside source not shown. As with the gas delivery channels 27 and 22 in FIGS. 3*a* and 3*b*, the porous refractory inserts (illustrated in FIG. 2—see refractory inserts 17, 23, 24, and 28) are present but not illustrated in FIG. 4 for the sake of simplicity. The gas flows from duct 39 into passage 18 of gas delivery channel 16 (which contains refractory insert 17—see FIG. 2) and thence through duct 40 to gas transfer channel 37, which does not contain porous refractory.

Figure 4B:
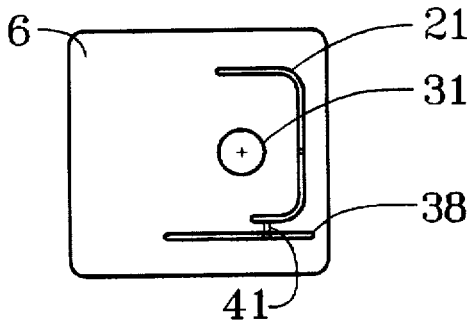
FIG. 4*b* is a simplified overhead view of the top of the slide plate, showing only the features relevant to the top surface.

The top surface of slide plate 6 is illustrated in FIG. 4*b*, showing gas delivery channel 21 connected to gas transfer channel 38 through duct 41.

Figure 4C:
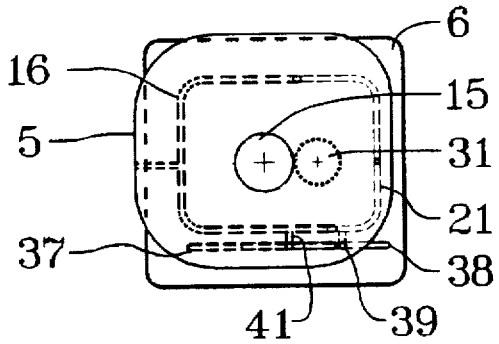
FIGS. 4*c*, 4*d*, and 4*e* show the relationship of the features of FIGS. 4*a* and 4*b* as the slide plate is moved leftward underneath the top plate into the "fully closed" or "entry" position (4*c*), the "throttle" or working position (4*d*), and the "exit" position (4*e*).
Figure 4D:
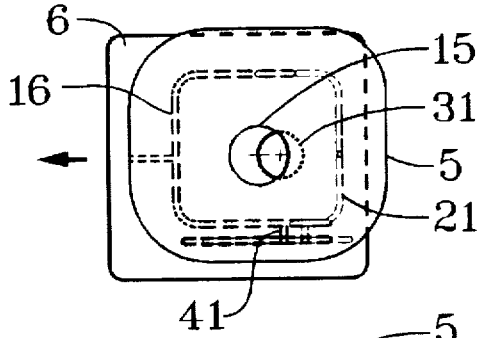

In the "fully closed" or "entry" position of FIG. 4*c*, the slide plate 6 has been moved leftward (as depicted and corresponding to FIG. 3*c*) but orifice 31 does not yet overlap orifice 15 of top plate 5. However, communication has been established between gas transfer channels 37 and 38 by reason of their overlapping positions, so that gas can flow from top plate 5 into the gas delivery channel 21 of slide plate 6. In FIG. 4*d*, the "throttle" position, metal may flow through orifices 31 and 15; inert gas flowing into gas delivery channels 16 and 21 and through porous refractory inserts 17 and 23 (see FIG. 2) provides a positive pressure in the interface of top plate 5 and slide plate 6, while a similar effect takes place at the interface of slide plate 6 and tube holder 7, as shown in FIG. 3*d* (see also refractory inserts 24 and 28 in FIG. 2). The positive inert gas pressure prevents air and other ambient gases from entering the tube holder orifice 32 where it could damage the relatively reactive molten steel.

Figure 4E:
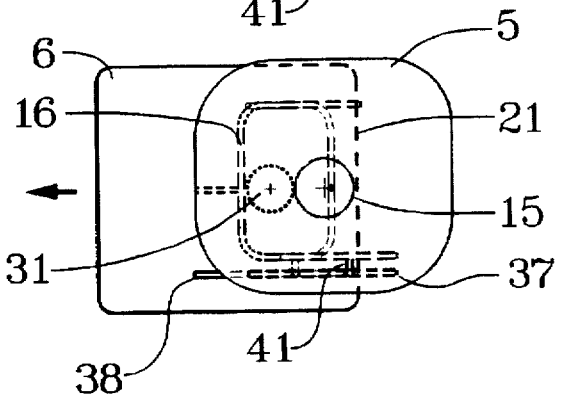

FIG. 4*e* shows the "exit" relationship of the gas delivery channels 16 and 21 and gas transport channels 37 and 38 as the slide plate 6 is moved leftward on termination of operation. The juxtaposition of top plate 5 and slide plate 6 shown in FIGS. 4*c*, 4*d*, and 4*e* may be contemplated as superimposed on top of corresponding juxtaposition of slide plate 6 on tube 7 illustrated in FIGS. 3*c*, 3*d*, and 3*e*.

Figure 5:
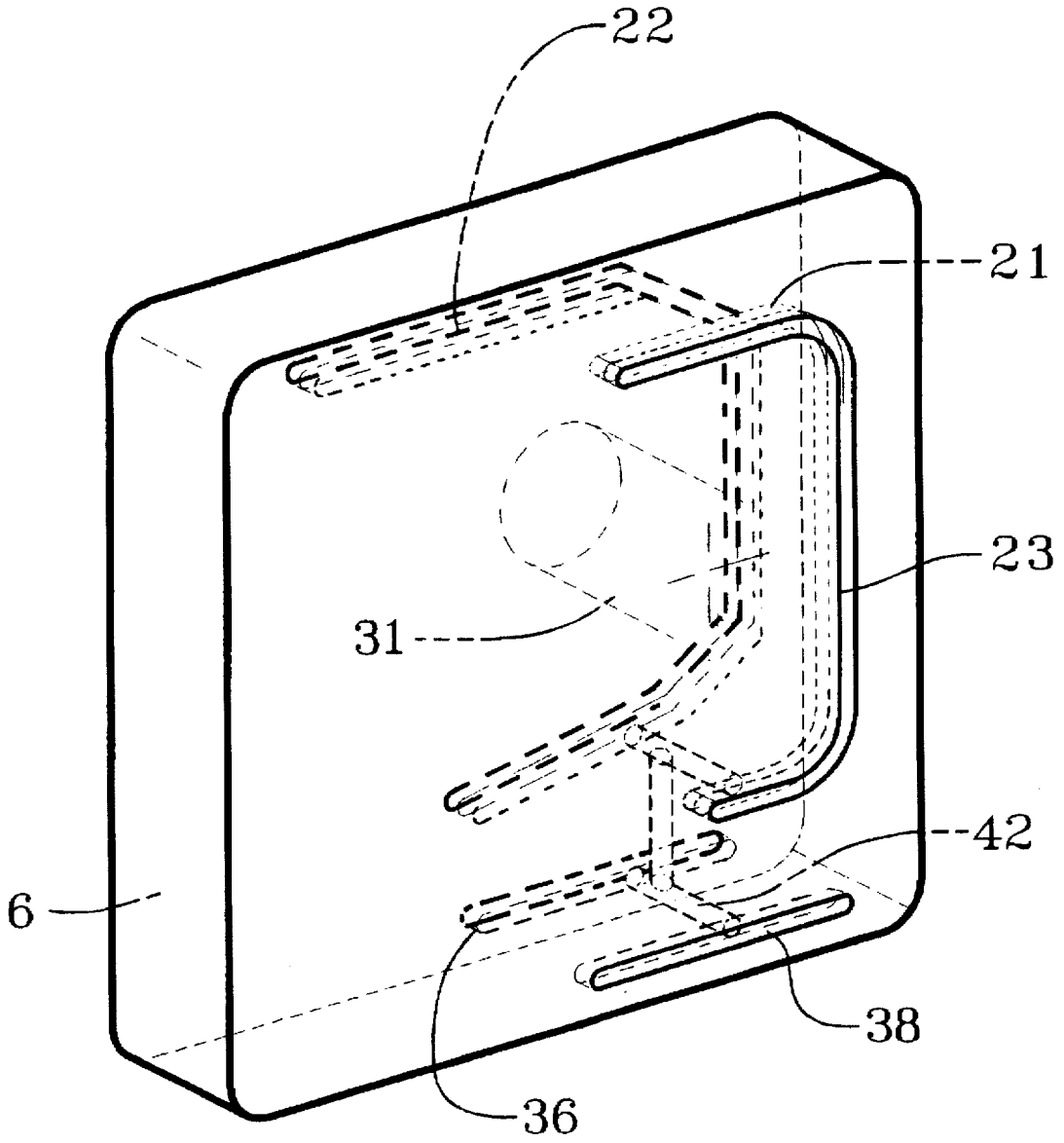

My invention includes the slide plate represented in perspective in FIG. 5, which shows the gas transfer channels 21 and 22, refractory insert 23, and gas transfer channels 36 and 38. This embodiment shows an H-shaped internal duct 42 which permits the flow of gas from either of the gas transfer channels 36 or 38 to both of the gas delivery channels 21 and 22. Duct 42 may be replaced by a simple duct connecting gas transfer channel 38 to gas delivery duct 21 and/or a simple duct connecting gas transfer channel 36 to gas delivery channel 22. In other words, for whatever reason, one may have separate gas delivery systems on the top and bottom of the slide plate; my invention includes such embodiments so long as a refractory insert 23 or 24 is present.

In FIG. 6, a variation of the slide plate 6 is shown having no gas transfer channels because it has its own gas supply system represented by T-shaped duct 43 which serves to supply inert gas from an outside source not shown to the passages 25 and 26 of gas delivery channels 21 and 22.

My invention thus includes a slide plate adapted to deliver inert gas as described, a slide gate valve having gas delivery systems as described, and apparatus for delivering molten steel to the top of a continuous caster including a tundish and a flow-directing means below it, each of the tundish and the flow-directing means having substantially flat surfaces forming an interface in at least one of which is built a gas delivery channel including a porous refractory insert extending throughout its length and having a depth extending from said substantially flat surface to partially fill said channel (preferably about half the depth of the channel, or about one-fourth to about three-fourths the depth); where gas delivery channels are on both surfaces, the surfaces may also have gas transfer channels for delivering gas from a source on or near one surface to a passage in a channel on the other surface.

I claim:

1. A slide plate for a continuous casting slide valve comprising a plate having an orifice therethrough for conducting molten metal an substantially flat upper and lower working surfaces for contacting substantially flat upper stationary and lower stationary surfaces, a channel on at least one of said upper and lower working surfaces for containing and conducting inert gas, each of said channel or channels being partially filled to the level of said working surfaces with porous refractory inserts which retain said gas in gas passages in said channels while permitting said gas to pass through said refractory inserts, and at least one duct for conducting inert gas from outside said slide plate to said gas passage in said channel.

2. A slide plate of claim 1 wherein each of said channels is substantially U-shaped.

3. A slide plate of claim 1 wherein said refractory inserts occupy about half the depths of said channels, the surfaces of said refractory inserts bring substantially even with said working surfaces.

4. A slide plate of claim 1 having a channel on each of said working surfaces.

5. A slide plate for a continuous caster slide gate valve comprising a slide plate having two substantially flat surfaces and a substantially centrally located hot metal flow directing orifice, substantially U-shaped channels on each surface, said substantially U-shaped channels being partially filled with porous refractory to form gas passages interior of said porous refractory, and duct means for connecting said gas passages.

6. Slide plate of claim 5 including gas transfer channels on each of said substantially flat surfaces for delivering gas to said gas passages.

7. Slide plate of claim 6 further including duct means connecting said gas transfer channels.

8. A slide gate valve for a continuous caster comprising a stationary element and a slide plate, each of said stationary element and said slide plate having an orifice therethrough for conducting flowing metal and a working surface in contact with the other, each of said working surfaces having gas delivery channels therein for conducting inert gas, each of said gas delivery channels connected to a source of inert gas, each of said gas delivery channels being partially filled with porous refractory inserts substantially even with said working surface while defining a gas passage inward of said refractory, each of said working surfaces including a gas transport channel for conducting gas from one gas transport channel to the other, said gas transport channels being proportioned and dimensioned so that when said orifices are aligned, said gas delivery channels will be connected to said gas transport channels and gas may pass from one gas transport channel to another.

9. A slide gate valve of claim 8 wherein said gas transport channels are proportioned and dimensioned so that when said orifices are aligned, said gas transport channels are linearly aligned.

10. A slide gate valve assembly for a continuous caster comprising a top plate, a slide plate, and a tube holder, each of said top plate, slide plate, and tube holder having substantially flat surfaces for substantially continuous contact with another, said slide plate being between said top plate and said tube holder, each of said substantially flat surfaces including a substantially U-shaped gas delivery channel therein, each of said substantially U-shaped gas delivery channels including a porous refractory insert filling only a shallow portion of said channel and forming a passage in the deeper portion thereof, and means for flowing inert gas into each of said passages, said means for flowing inert gas into each of said passages comprising open gas transport channels on said substantially flat surface of said top plate and on said substantially flat surface of said slide plate, said open gas transport channels being placed such that said open gas transport channel on said top plate will convey gas to said open gas transport channel in said slide plate when said substantially flat surfaces are in contact.

11. A slide gate valve assembly for a continuous caster comprising a top plate, a slide plate, and a tube holder, each of said top plate, slide plate, and tube holder having substantially flat surfaces for substantially continuous contact with another, said slide plate being between said top plate and said tube holder, each of said substantially flat surfaces including a substantially U-shaped gas delivery channel therein, each of said substantially U-shaped gas delivery channels including a porous refractory insert filling only a shallow portion of said channel and forming a passage in the deeper portion thereof, and means for flowing inert gas into each of said passages, said means for flowing inert gas into each of said passages comprising open gas transport channels on said substantially flat surface of said tube holder and on said substantially flat surface on said slide plate, said open gas transport channels being placed such that said open gas transport channel on said tube holder will convey gas to said open gas transport channel on said slide plate when said substantially flat surfaces are in contact.

12. Apparatus for delivering molten steel to the top of a continuous caster comprising a tundish including a bottom orifice for delivering molten steel and having a substantially flat lower surface surrounding said orifice, and a slide plate for directing the flow of molten steel from said orifice, said slide plate having a flow-directing orifice and a substantially flat upper surface forming an interface with said substantially flat lower surface of said tundish, at least one of said substantially flat surfaces having thereon a gas delivery channel for delivering inert gas to said interface, said gas delivery channel including a porous refractory insert extending the full length of said gas delivery channel and having a depth extending from said substantially flat surface to partially fill said channel, thereby forming a gas passage in the interior of said gas delivery channel, and means for transferring inert gas to said gas passage under pressure, whereby inert gas may be transferred into said passage and through said porous refractory to said interface of said substantially flat surfaces.

13. Apparatus of claim 12 wherein each of said substantially flat surfaces has on it a gas delivery channel.

14. Apparatus of claim 12 wherein said upper and lower substantially flat surfaces each contains a gas delivery channel and a gas transfer channel, said gas delivery channels containing porous refractory inserts and said gas transfer channels being configured to transfer gas from one to the other and to said passages of said gas delivery channels when said slide plate is directing flow of molten steel from said orifice.

* * * * *